US011208824B1

(12) United States Patent
Kemmsies

(10) Patent No.: US 11,208,824 B1
(45) Date of Patent: Dec. 28, 2021

(54) APPARATUS FOR PLUMBING TRANSMISSION OR DISTRIBUTION POLES

(71) Applicant: Kenneth Craig Kemmsies, Castaic, CA (US)

(72) Inventor: Kenneth Craig Kemmsies, Castaic, CA (US)

( * ) Notice: Subject to any disclaimer, the term of this patent is extended or adjusted under 35 U.S.C. 154(b) by 0 days.

(21) Appl. No.: 17/129,866

(22) Filed: Dec. 21, 2020

Related U.S. Application Data

(60) Provisional application No. 62/952,208, filed on Dec. 20, 2019.

(51) Int. Cl.

| | |
|---|---|
| ***E04H 12/22*** | (2006.01) |
| ***B66F 3/12*** | (2006.01) |
| ***E04H 12/20*** | (2006.01) |
| ***E04C 3/30*** | (2006.01) |
| ***E04H 12/34*** | (2006.01) |

(52) U.S. Cl.
CPC ..... *E04H 12/2284* (2013.01); *B66F 3/12* (2013.01); *E04C 3/30* (2013.01); *E04H 12/20* (2013.01); *E04H 12/2253* (2013.01); *E04H 12/347* (2013.01)

(58) Field of Classification Search
CPC ..... E04C 3/30; E04H 12/20; E04H 12/2253; E04H 12/2284; E04H 12/345; E04H 12/347; B66F 3/12
See application file for complete search history.

(56) References Cited

U.S. PATENT DOCUMENTS

| | | | | |
|---|---|---|---|---|
| 3,290,008 | A * | 12/1966 | White | B66F 3/12 254/122 |
| 9,883,147 | B1 * | 1/2018 | Zaluski | H04N 7/185 |
| 10,634,122 | B1 * | 4/2020 | Clifton | E04H 12/345 |
| 10,745,931 | B1 * | 8/2020 | Gathers | E01F 9/629 |
| 2014/0311083 | A1 * | 10/2014 | Madril | E04H 12/20 52/741.14 |
| 2017/0327357 | A1 * | 11/2017 | Bainter | B66F 3/46 |
| 2018/0202183 | A1 * | 7/2018 | Moore | E04H 12/347 |

FOREIGN PATENT DOCUMENTS

| | | | | |
|---|---|---|---|---|
| EP | 3587709 | A1 * | 1/2020 | E04H 12/2284 |
| ES | 2351758 | A1 * | 2/2011 | F24S 25/617 |
| KR | 101642963 | B1 * | 8/2016 | |

* cited by examiner

*Primary Examiner* — Jessie T Fonseca
(74) *Attorney, Agent, or Firm* — Law Office of David Hong

(57) ABSTRACT

An apparatus for plumbing a transmission or distribution pole comprising: multiple pole brackets connected with an adjustable ratchet strap; multiple scissor jacks with each having a jack mount; at least one power drill or hand crank to adjust the scissor jack; whereby the pole can be efficiently adjusted into the proper plumb or leveled position.

20 Claims, 10 Drawing Sheets

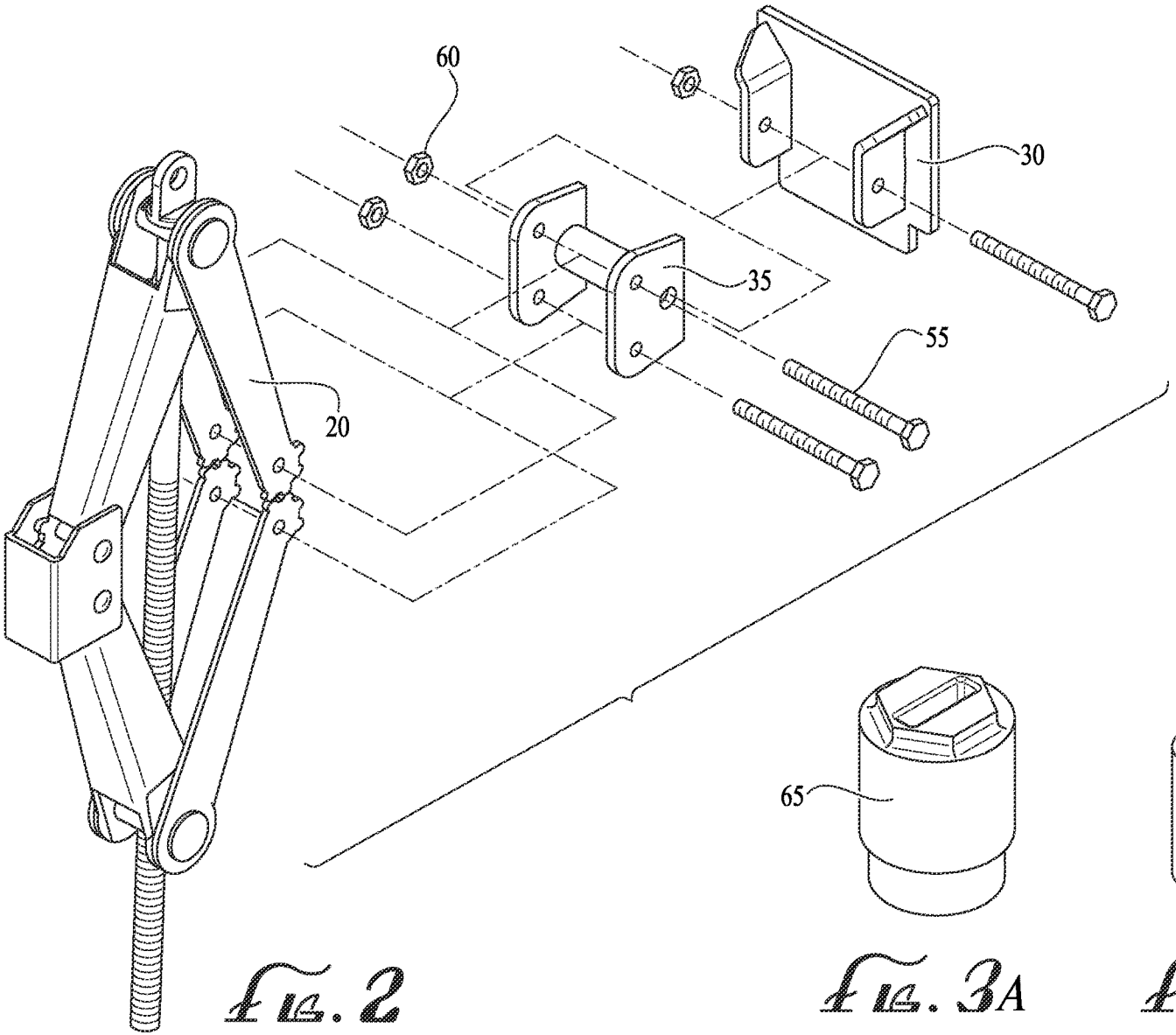
FIG. 2
FIG. 3A
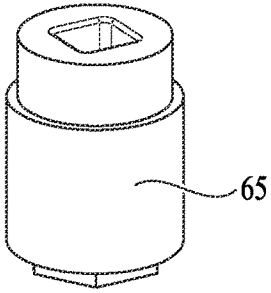
FIG. 3B

APPARATUS FOR PLUMBING TRANSMISSION OR DISTRIBUTION POLES

PRIORITY CLAIM

This application claims the benefit of U.S. Provisional Patent Application No. 62/952,208, filed on Dec. 20, 2019, which is incorporated by reference in entirety.

BACKGROUND OF INVENTION

1. Field of Invention

This invention relates to an apparatus and method for plumbing, leveling, truing and installing transmission and distribution poles into the ground.

2. Description of Related Art

As long as there is a need for transmitting electricity, telephone and other communication wires across land, there is a need for installing transmission and distribution poles, typically wood poles and other materials. Typically, transmission lines are placed in remote parts of the country, where there is no road access or no access by vehicles; helicopters and other hovering aircraft must transport and deliver all personnel, poles and equipment into these remote areas.

Generally, after the holes are dug, helicopters transport these transmission poles into the pole site, and installation personnel have to properly orient, level or plumb the poles before backfilling the holes with dirt so that the transmission/power lines can be installed onto the poles. This orientation and plumbing process is a tedious and time-consuming job that requires use of lines and up to three anchor points in order to properly plumb and align the pole properly. If there are no existing trees or rocks to anchor the orientation lines, anchor holes and anchor weights must be dug and installed. All more work for installing one pole.

From the preceding descriptions, it is apparent that the devices currently being used have significant disadvantages. Thus, important aspects of the technology used in the field of invention remain amenable to useful refinement.

SUMMARY OF THE INVENTION

This invention relates to an apparatus for plumbing, truing, straightening a transmission/distribution pole comprising: multiple or at least three pole brackets connected with a rope or strap (preferably an adjustable ratchet strap), which are placed around the lower end or butt of a pole; multiple or at least three scissor jacks each have a jack mount to engage the pole brackets; the jack mount comprises a scissor jack drop in plate and a scissor jack axle; the scissor drop in plate is rotatably connected to the scissor jack axle; the scissor jack axle and fixedly secured to the scissor jack. Connection means are preferably nut and bolts.

An apparatus for plumbing and leveling a pole at an installation site comprising: multiple scissor jacks; each scissor jack having a jack mount; each jack mount has a scissor jack drop in plate and a scissor jack axle; the scissor jack is fixedly connected to the scissor jack axle; the scissor jack drop in plate is rotatably connected to the scissor jack axle; multiple pole brackets are equally arranged around the pole and connected with a strap; each pole bracket having a first pole bracket side and a second pole bracket side; each first pole bracket side has two pole bracket arms to grasp a surface of the pole; each second pole bracket side forms a receiving area to receive the scissor jack drop in plate; each pole bracket having an opening for passing through the strap and securing around the pole.

Each scissor jack is adjustable with a turning screw; a power drill or a hand crank to turn the turning screw and to adjust each scissor jack; the power drill or the hand crank engages the turning screw using a socket jack adapter; whereby after the pole is transported to the installation site and inserted into a hole, the scissor jack and the jack mount engage the receiving area of the second pole bracket side; whereby the power drill or the hand crank turns the turning screw to adjust the scissor jack so that pole and the apparatus are securely fixed in the hole of the installation site and so that the pole position can be adjusted to be plumb; the receiving area of the pole bracket has a slot to receive a tab on the scissor jack drop in plate.

The strap can use a ratchet and a clip end; multiple straps can be used; the scissor jack can be fixedly connected to the second jack mount side with nuts and bolts; the first pole bracket side has multiple pole bracket wedges or wings to help properly orient the pole.

The present invention introduces such refinements. In its preferred embodiments, the present invention has several aspects or facets that can be used independently, although they are preferably employed together to optimize their benefits. All of the foregoing operational principles and advantages of the present invention will be more fully appreciated upon consideration of the following detailed description, with reference to the appended drawings.

BRIEF DESCRIPTION OF THE DRAWINGS

FIG. 2 shows an exploded view of the scissor jack and jack mount; the jack mount comprises a scissor jack axle, a scissor jack drop in plate and multiple bolts and nuts.

FIG. 3A and FIG. 3B show perspective views of the socket jack adapter to allow use of a power drill on the scissor jack.

Scissor jack drop in plate.

Pole Bracket.

PARTS LISTING

Figure 1:
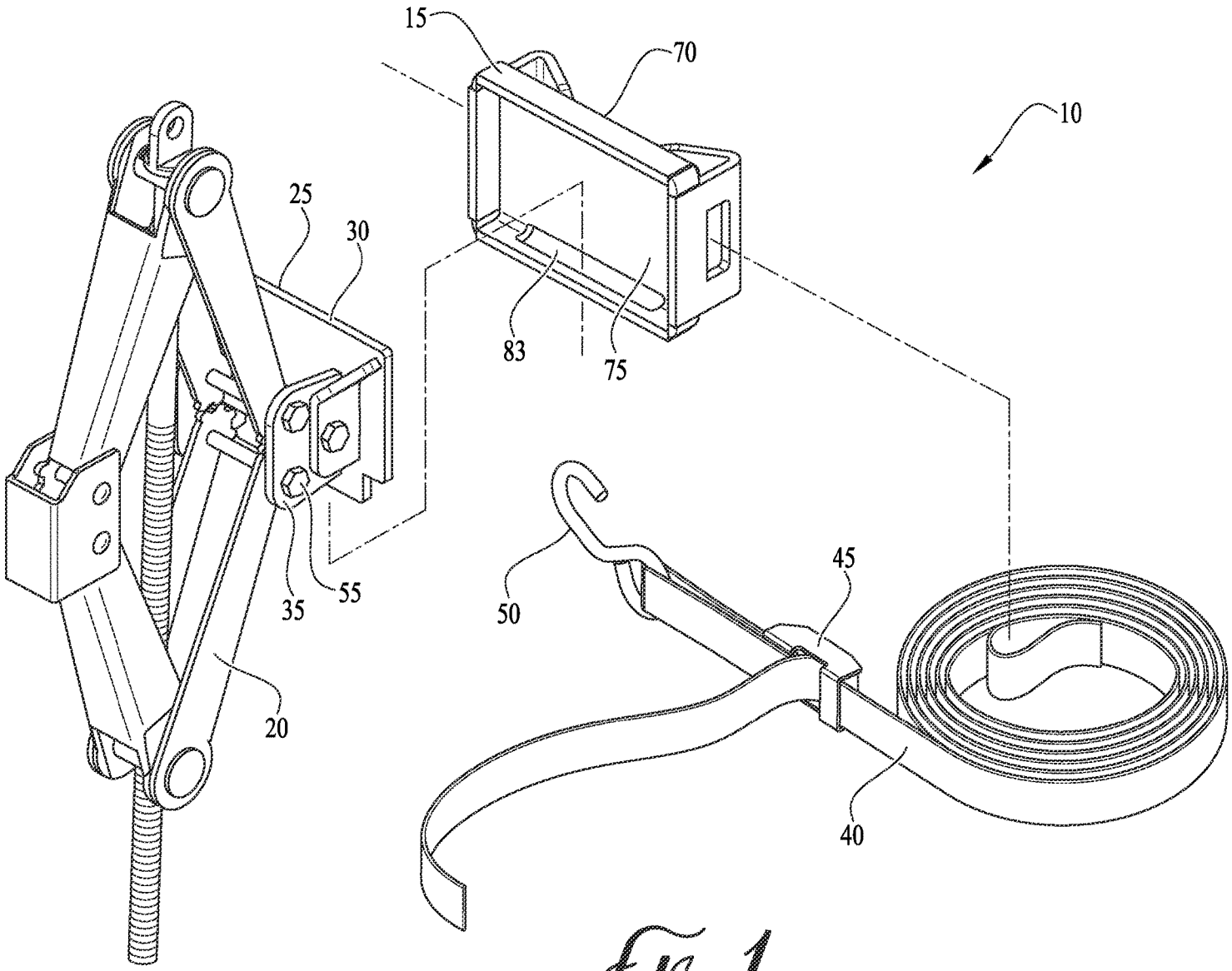
FIG. 1 shows an exploded view of one preferred embodiment of the invention, namely: a pole bracket, a strap (with a ratchet and a clip) and a scissor jack with a jack mount; the jack mount comprises a scissor jack axle and a scissor jack drop in plate.
Figure 4B:
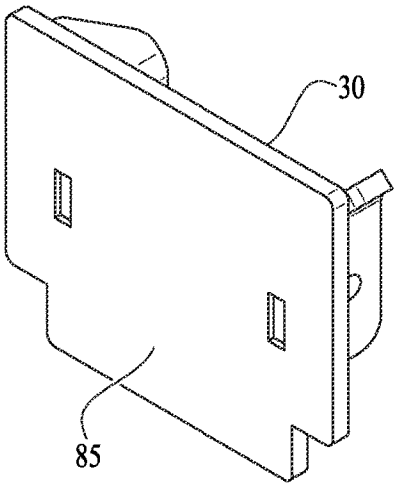
FIG. 4B (second perspective view)
Figure 4D:
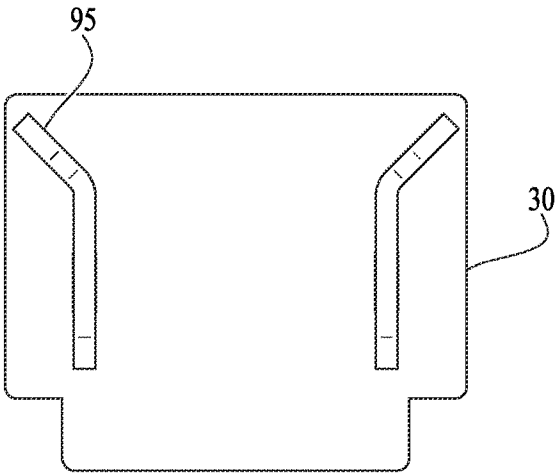
FIG. 4A (first perspective view)
FIG. 4C (side view) and FIG. 4D (front view) of the scissor jack drop in plate.
Figure 4A:
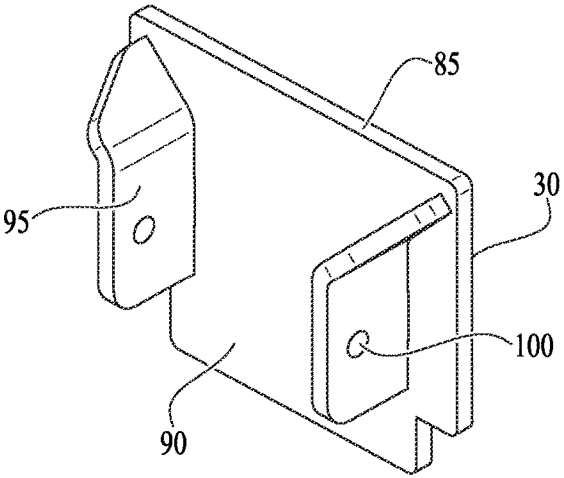
Figure 4C:
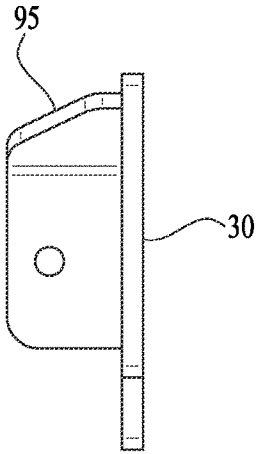

10 Apparatus for Plumbing Transmission or Distribution Poles
11 pole
12 hole
15 Pole bracket
20 Scissor jack
25 Jack mount
  30 Scissor jack drop in plate
  35 Scissor jack axle
40 Strap
45 Ratchet for strap
50 Clip
55 bolts
60 nuts
65 socket jack adapter
66 power drill
15 Pole bracket
  70 $1^{st}$ side to the pole
  75 $2^{nd}$ side to act as a receiver for the jack bracket
  80 pole bracket arms to grab the pole surface
  82 opening on pole bracket arms for the strap
  83 slot for lower tab from scissor jack drop in plate
30 scissor jack drop in plate
  85—$1^{st}$ side that engages the $2^{nd}$ side of the pole bracket
  90—$2^{nd}$ side that has scissor jack drop in plate arms that engage the ends of the scissor jack axle
  95 scissor jack drop in plate arms
  100 holes on scissor jack drop in plate arms
35 scissor jack axle
  105 axle ends
  110 holes on axle ends
115 Pole bracket in FIG. 6A-6C
  120 $1^{st}$ side to the pole
  125 $2^{nd}$ side to act as a receiver for the jack bracket
  130 pole bracket arms to grab the pole surface
  135 bracket wings or sidewalls
  140 opening on bracket wings for strap (wings create a nesting space for the scissor jack)
  145 tabs on bracket wings

DETAILED DESCRIPTION OF THE INVENTION

Figure 6C:
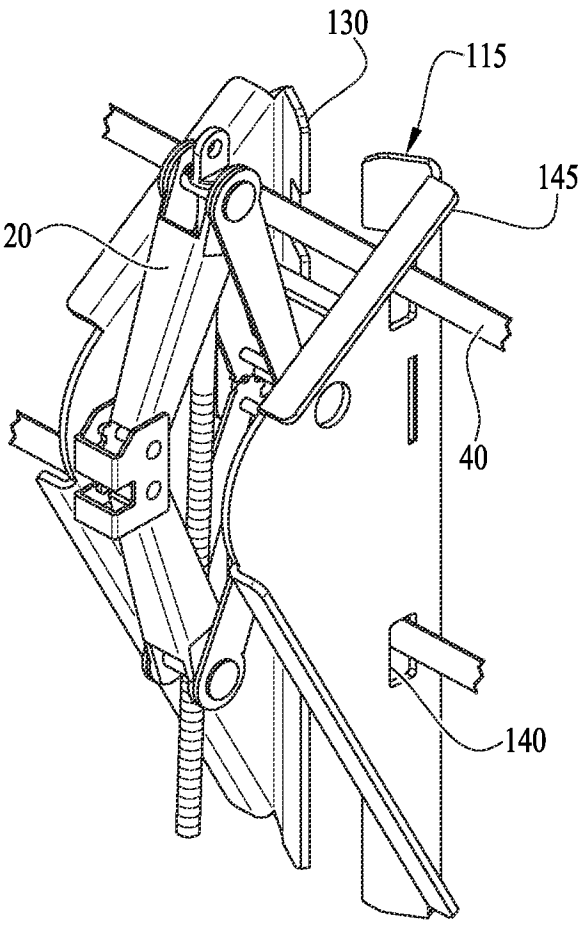
FIGS. 6A, 6B and 6C show another preferred embodiment of the pole bracket; in this embodiment, there are expanded bracket sides (wings or spacer portion), which allow for two slots for the strap to pass and allow for more coverage around the scissor jack. These expanded bracket sides, wings or spacer portions help orient the pole away from the inside of the hole.
Figure 6B:
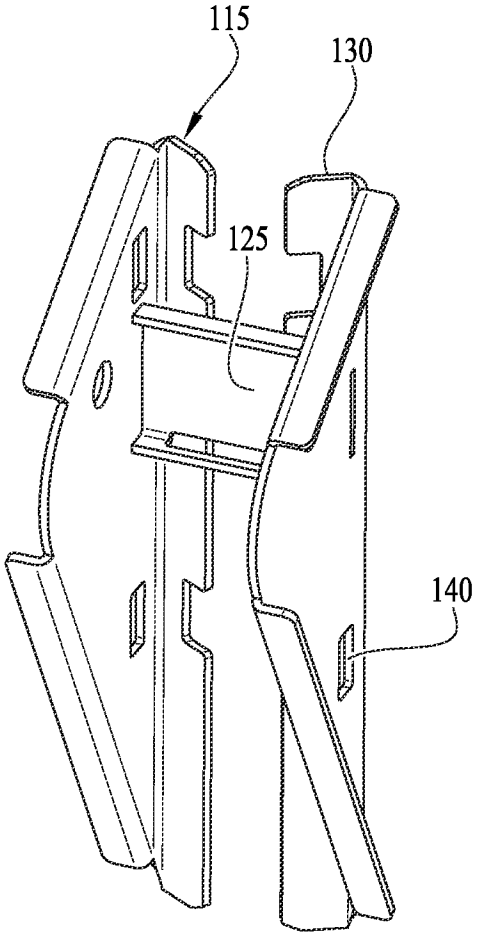
Figure 6A:
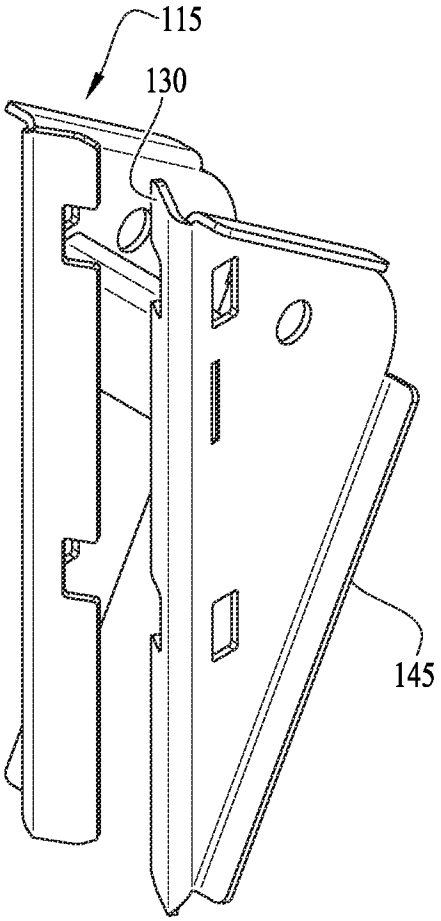
Figure 7:
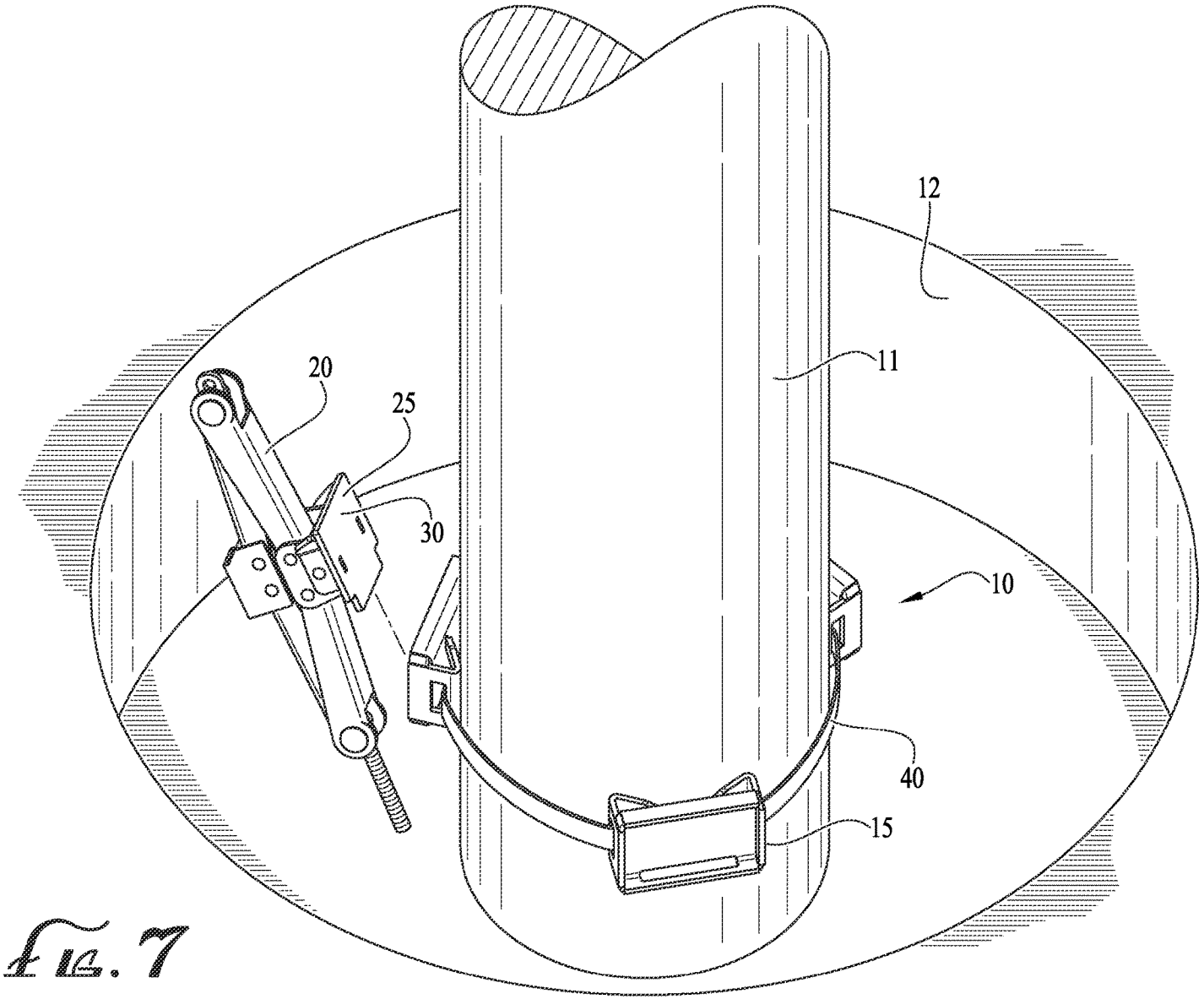
FIG. 7 shows how the multiple pole brackets and strap is placed around the lower end of the pole and the placement of the closed scissor jack and within a hole in the ground.
Figure 8:
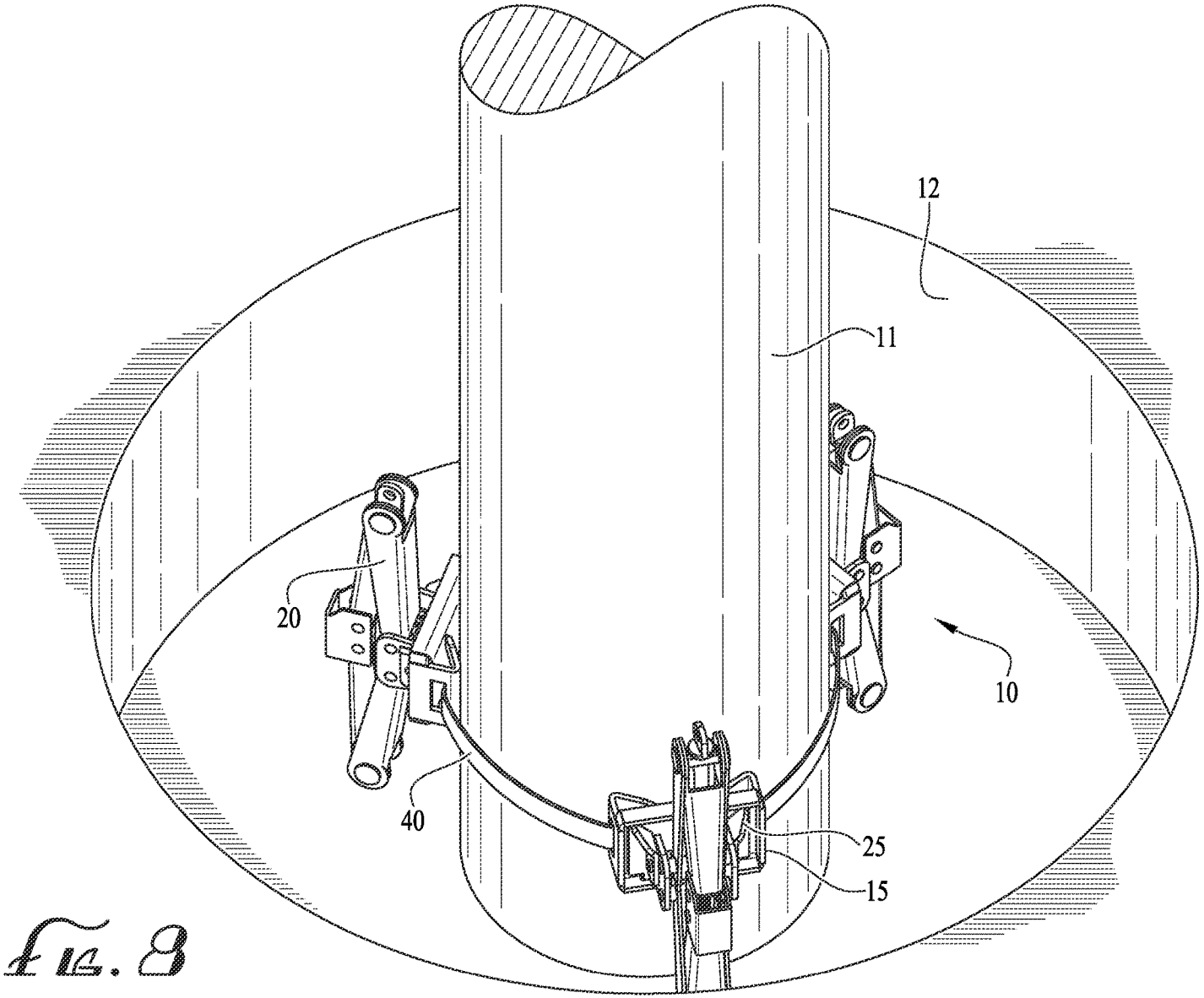
FIG. 8 shows how three scissor jacks engage the three pole brackets and strap, which are placed around the lower end of the pole and within a hole in the ground.
Figure 9:
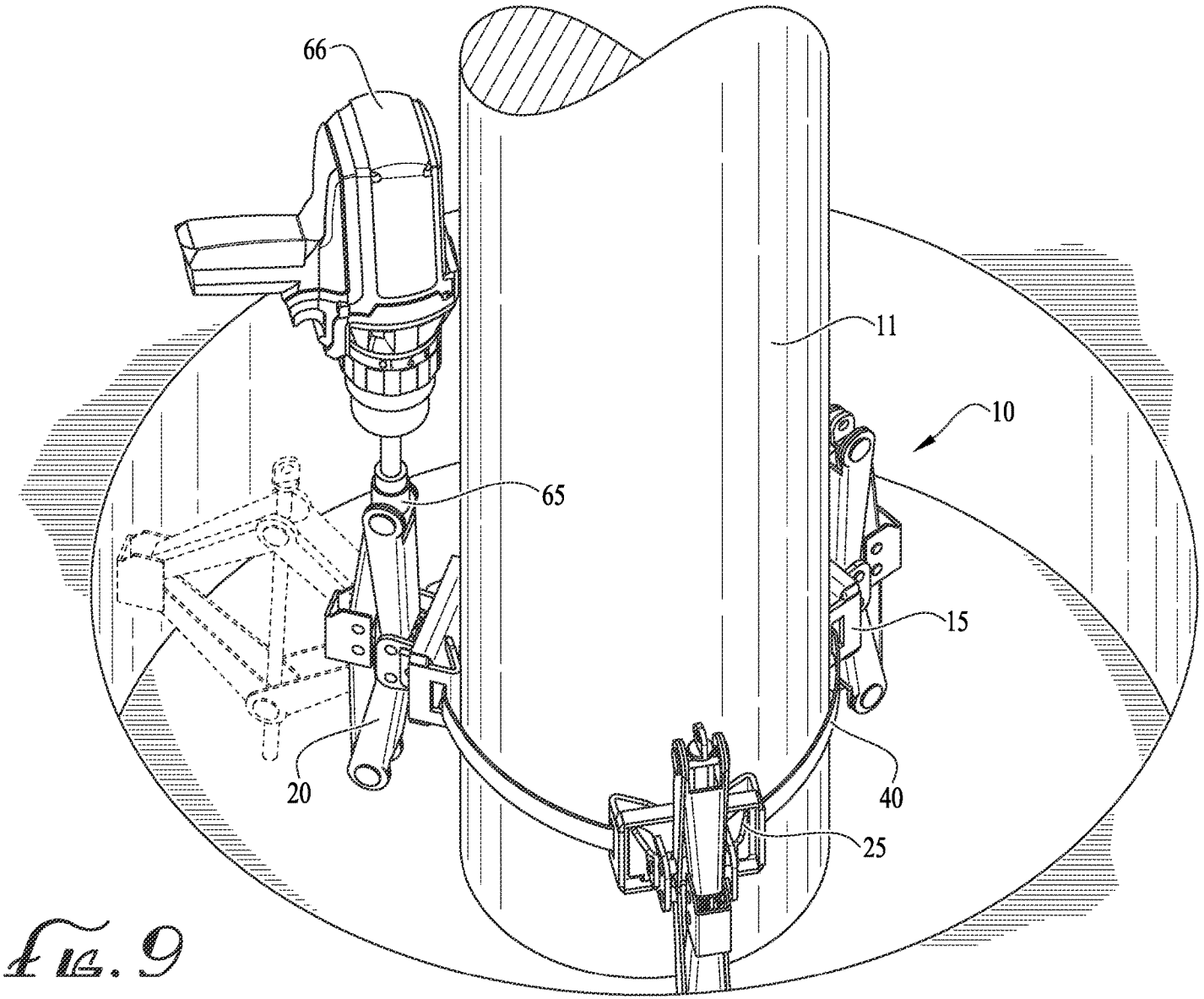
FIG. 9 shows how the scissor jack can be expanded or opened using a power drill and adapter and within a hole in the ground.
Figure 10:
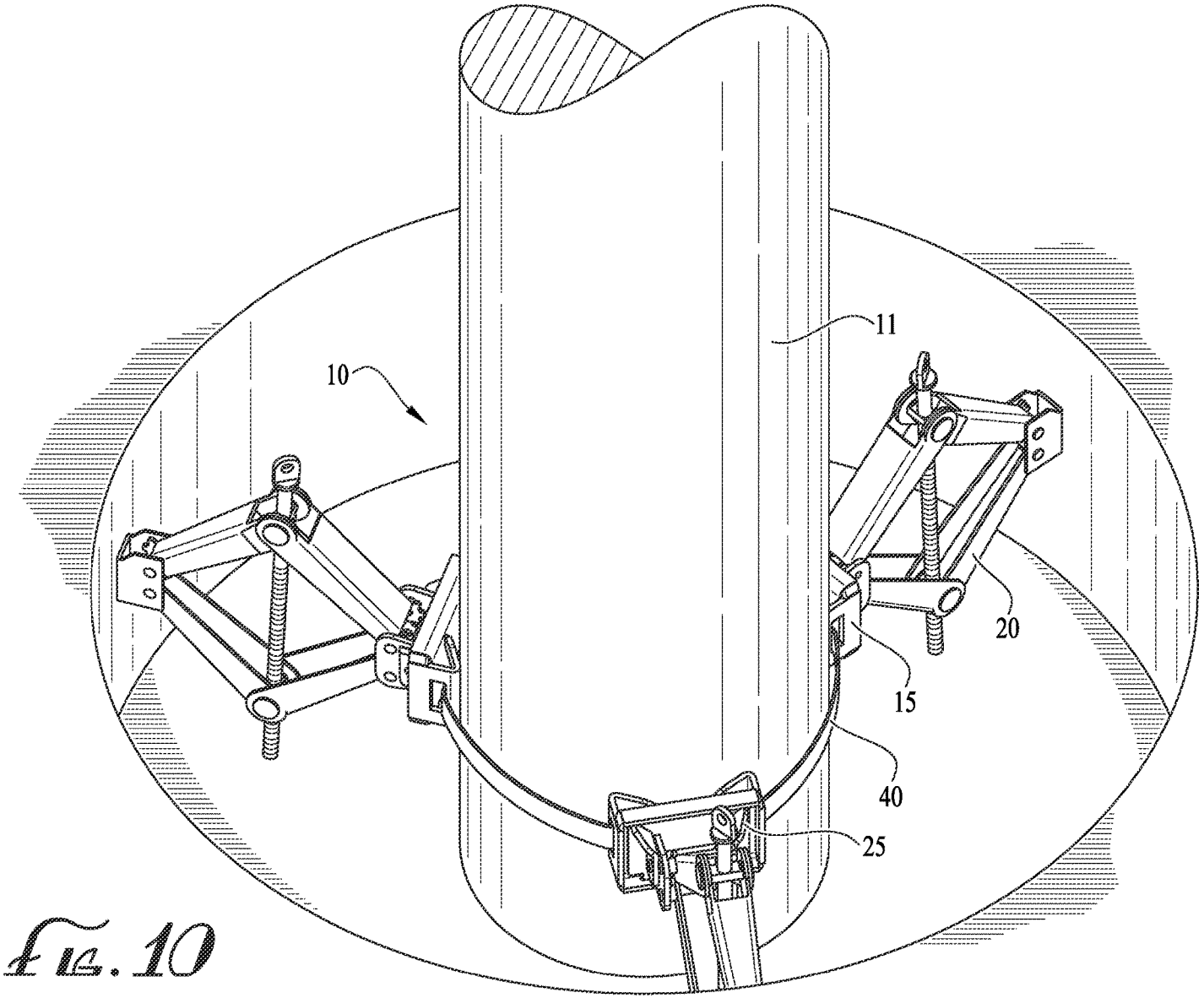
FIG. 10 shows how the multiple pole brackets and strap is placed around the lower end of the pole and with the fully opened or expanded scissor jacks and within a hole in the ground.
Figure 11:
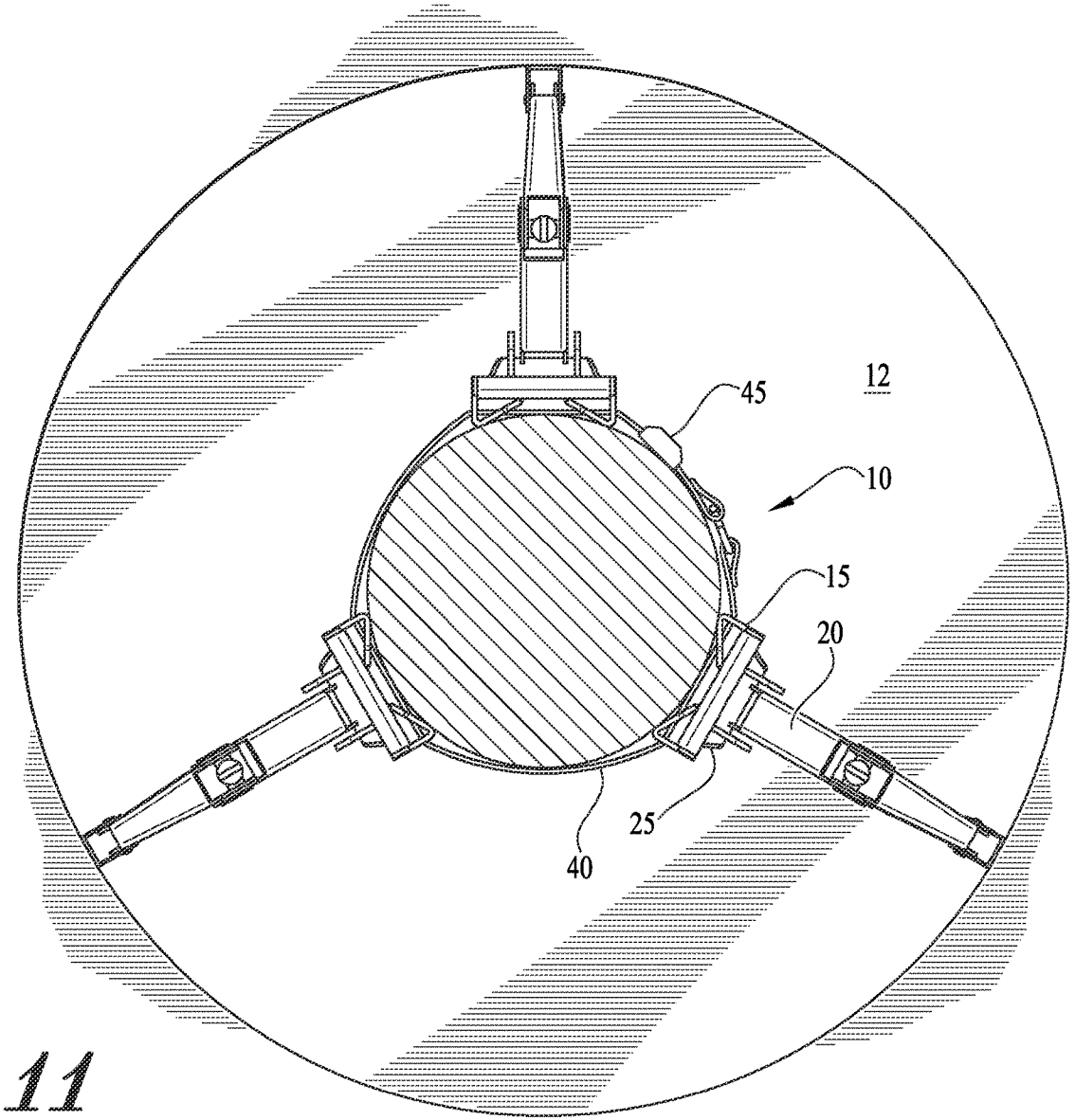
FIG. 11 shows a top view of one embodiment of the invention.

As shown in FIG. 1-10, this invention relates to an apparatus for plumbing, leveling or trimming a transmission, utility or distribution pole comprising: multiple or at least three pole brackets connected with a rope or strap (preferably an adjustable ratchet strap), which are tightened around the lower end, butt or portion of a pole. Once the transmission or power pole is placed in the designated hole for installation, the installers will place multiple or at least three scissor jacks with each having a jack mount (a scissor jack drop in plate and a scissor jack axle) to the pole brackets. The scissor jack drop in plate will engage, mate or fit within the receptacle formed in the pole bracket (second side); a lower tab of the scissor jack drop in plate (as shown in FIG. 4A, 5A and FIG. 7) can fit within a slotted opening 83 on the bottom portion of the second side of the pole bracket.

The scissor jacks will be expanded or opened until the scissor jack ends are securely engaged to the inner wall of the hole. The installers can then use leveling methods to properly orient the poles so that they are plumb. The installers then can fill up the hole area around the pole end with dirt and tamp, and the apparatus can be removed.

This apparatus for plumbing transmission or distribution or utility poles comprises at least one scissor jack, at least one pole bracket and a jack mount assembly (scissor jack drop in plate and a scissor jack axle, which are attached to the scissor jack with nuts and bolts). The scissor jack drop in plate rotates in relation to the scissor jack and the scissor jack axle.

One or multiple straps can be fed through holes, slots or openings on the pole bracket and tightened securely around the pole; preferably a ratcheting system is used with the strap or rope and some sort of connecting clip.

Pole Bracket:

The pole bracket has a first side (pole side) and a second side (scissor jack side); the first side of the pole bracket engages the sides of the pole; the second side of the pole bracket has a structure to act as a receiver to the scissor jack drop in plate. On the first side of the pole bracket, there can be a groove or multiple or two pole bracket arms, wedges or wings to grab the pole surface. The groove, arms, wedges or wings help properly orient the pole into the hole.

Figure 5A:
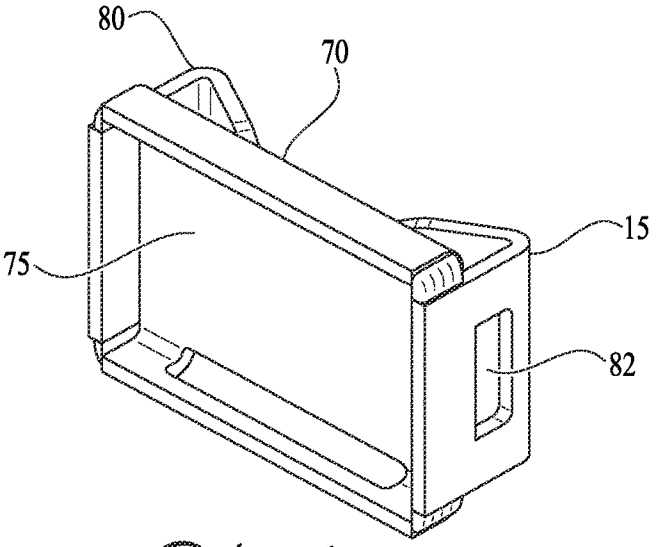
FIG. 5A (first perspective view)
Figure 5B:
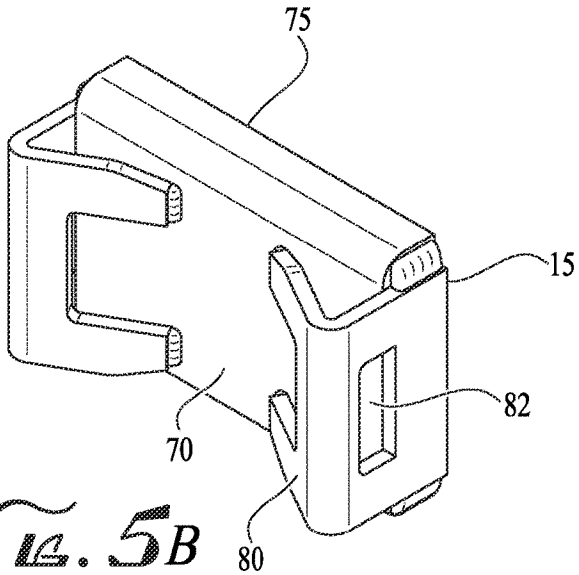
FIG. 5B (second perspective view)
Figure 5C:
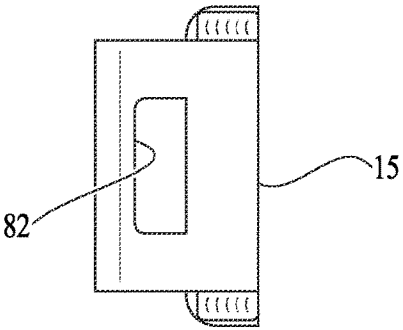
FIG. 5C (side view) and FIG. 5D (bottom view of the pole bracket contacting the pole).
Figure 5D:
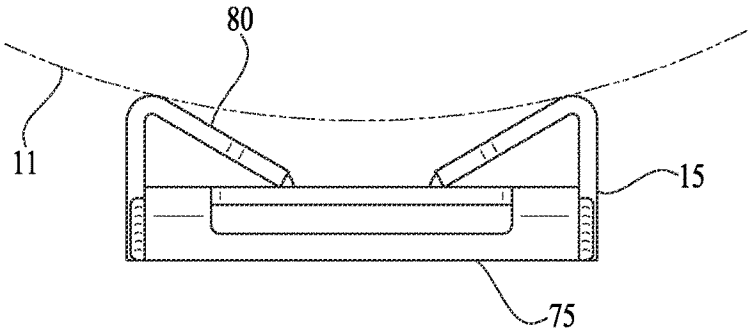

On the first side of the pole bracket, at least one opening on the pole bracket allows for the strap to pass; in FIGS. 1, 2 and 5A, this opening for the straps is located on the pole bracket arms. In FIGS. 6A, 6B and 6C, these openings for the straps can be located on a different part of the pole bracket body.

Scissor Jack and the Jack Mount Assembly:

As shown in FIGS. 1 and 2, there is a scissor jack and a jack mount. The jack mount comprises a scissor jack drop in plate and a scissor jack axle. The jack mount is securely fastened to the scissor jack with nuts and bolts or other attachment means.

The scissor jack drop in plate has a first side that engages the second side of the pole bracket; the scissor jack drop in plate also has a second side, which has the scissor jack drop in plate arms that engage the ends of the scissor jack axle; these scissor jack drop in plate arms can have holes to allow connection with nuts and bolts to the scissor jack and the scissor jack axle. In other embodiments, it may be possible to have the scissor jack axle already affixed to the scissor jack; the scissor jack drop in plate should still be able to rotate; without being limiting, an acceptable amount of rotation is approximately 15 to 25 degrees. The scissor jack axle has axle ends and holes on the axle ends for the connecting bolts and nuts.

Alternative Pole Bracket with Wings:

In FIGS. 5A, 5B, 5C and 5D, there are views of the pole bracket; there is a first side that engages the pole; this first side can have curved or angled projections to grasp the rounded edge of the pole; the second side can have a four-sided shelf to securely engage one side of the scissor jack.

In another embodiment as shown in FIGS. 6A, 6B and 6C, this second side has wedges or wings to help orient the apparatus away from the inside of the hole and to allow for room to insert or engage with scissor jack; this version of the pole bracket has a first side (to the pole) and a second side (acting as a receiving area for the jack bracket); in a different embodiment on the second side of the pole bracket, there are bracket wings or sidewalls 135 that help orient the attached pole properly during initial placement (via helicopter or crane).

Normally, the pole brackets are placed evenly around the pole and secured with the strap or rope before transport of the pole to the installation site by helicopter or crane. These enlarged wedges or wings 135 also have tabbed or flanged edges 145 that provide a solid surface to push against the inside of the installation hole. These tabbed edges can extend all along the outer edge of the wings or wedges.

This version of the pole bracket has two or more openings or slots for two or more straps or ropes to be used to better balance the pole bracket around the pole. A rope or strap or a ratchet-type strap can be used to connect multiple brackets together; in most power pole configurations, three brackets is ideal, but other numbers can be used for large width poles.

In one example, the multiple pole brackets, which are connected with the adjustable ratchet strap or straps, are placed around the butt of the pole; the pole is transported to the pole installation site with the already dug hole. The wings or sidewalls 135 on the pole bracket help orient the pole within the hole; this is especially useful when the pole is placed in the hole with a helicopter or crane; the wings or sidewalls act as guides to keep the pole upright and generally centered. Further, there are tabbed or flanged edges on these wings or sidewalls to act as a guide against the inside of the dug hole. These tabbed edges help prevent the wings from digging into the dirt walls of the hole.

Then, the pole installers will place the scissor jacks with the jack mounts to the pole brackets. The scissor jack drop in plate can fit within the receiver area on the pole bracket; further, the lower tab on the drop in plate can fit and engage the slotted opening within the pole bracket.

Each scissor jack is adjusted (manually or with a power drill and socket jack adapter) to the proper vertical position (adjusting or measuring multiples times with a string line or other leveling means (including leveling lasers); measuring a first position; then a second position at 90 degrees; once proper position of the pole is achieved and (i.e., plumb), the pole hole is backfilled with dirt or soil; then remove the apparatus for another pole installation.

The scissor jacks are adjustable and have a turning screw, which allows the jack to move from a first or closed position to a second or open or expanded position; this apparatus preferably employs at least one power drill or hand crank to engage the turning screw to spread or to close the scissor jack. The power drill can engage the scissor jack using a socket jack adapter.

Method of Use

This invention also presents a method of using this apparatus for leveling, plumbing and installing transmission and distribution poles into the ground. In the fly yard or landing zone, a helicopter lands and picks up material, personnel and poles; the pole brackets and ratcheting straps would be placed on each pole prior to the helicopter moving the poles to the installation site. Once the multiple pole brackets with ratchet straps are installed on the pole and delivered to the installation site, the helicopter drops the pole into the hole; then the installation team will place scissor jacks in each bracket area (second side where the jack is engaged to the bracket pocket); then the jack is opened or closed to push the pole to the proper plumb position. The scissor jack can be adjusted with a portable power drill with a socket adapter or a manual crank.

To properly orient the pole, a simple two string line technique can be used and repeated at a 90-degree angle to confirm the plumb position. Once the pole is plumb, the installation crew will begin backfilling dirt around pole into the ground and tamp; once the butt end of the pole is set properly, the apparatus can be removed and pole hole is fully filled with dirt and tamped.

Operation of a Scissor Jack

A scissor jack is operated by turning a small crank that is inserted into one end of the scissor jack. This crank is usually "Z" shaped. The end fits into a ring hole mounted on the end of the screw, which is the object of force on the scissor jack. When this crank is turned, the screw turns, and this raises the jack. The screw acts like a gear mechanism. It has teeth (the screw thread), which turn and move the two arms, producing work. A power drill and an adapter can also be used to turn the crank.

A typical scissor jack has four main pieces of metal and two base ends. The four metal pieces are connected at the corners with a bolt that allows the corners to swivel. A screw thread runs across this assembly and through the corners.

As the screw thread is turned, the jack arms travel across it and collapse or come together, forming a straight line when closed. When the screw thread is turned in the opposite direction to open or to expand the jack, the four-metal arms contract together, coming together at the middle, raising the jack. When closed, the arms spread back apart, and the jack closes or flattens out again. A scissor jack uses gears to transfer the rotation of the crank to expand or to contract the jack. As the screw section is turned, two ends of the jack move closer together. Because the gears of the screw are pushing up the arms, the amount of force being applied is multiplied.

This application presents an apparatus for plumbing or leveling a transmission, distribution or utility pole at an installation site comprising: multiple or at least three scissor jacks; each scissor jack having a jack mount; each jack mount has a rotatable scissor jack drop in plate and a scissor jack axle; the scissor jack is fixedly connected to the scissor jack axle; the scissor jack drop in plate rotates in relation to the scissor jack and the scissor jack axle.

Also, there can be multiple or at least three pole brackets equally arranged around the pole and connected with a strap or at least one strap; each pole bracket can have a first pole bracket side and a second pole bracket side; each first pole bracket side can have multiple pole bracket arms to grasp a surface of the pole; each second pole bracket side can forms a receiving area to receive the scissor jack drop in plate; each pole bracket can have an opening or multiple slots for passing through the strap or straps and securing around the pole; each second pole bracket side can have multiple wedges or wings to help orient the apparatus away from an inside surface of the hole.

Each scissor jack is adjustable with a turning screw, which is engaged by a power drill or hand crank; the power drill or the hand crank can engage the turning screw using a socket jack adapter; whereby after the pole is transported to the installation site and inserted into a hole, the scissor jack and the jack mount engage the receiving area of the second pole bracket side; whereby the power drill or hand crank turns the turning screw to adjust the scissor jack so that pole and the apparatus are securely fixed in the hole of the installation site and so that the pole position can be adjusted to be plumb or level.

The receiving area of the pole bracket can have an opening or a slot to receive the scissor jack drop in plate or a tab on the scissor jack drop in plate; first pole bracket side has two pole bracket wedges or wings to help properly orient the pole; the second pole bracket side can have multiple wedges or wings to help orient the apparatus away from an inside surface of the hole; each multiple wedges or wings can have tabs.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting; but rather, to provide an understandable description of the invention.

The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly, and not necessarily mechanically.

Any element in a claim that does not explicitly state "means for" performing a specific function, or "step for" performing a specific function, is not be interpreted as a "means" or "step" clause as specified in 35 U.S.C. Sec. 112, Paragraph 6. In particular, the use of "step of" in the claims herein is not intended to invoke the provisions of 35 U.S.C. Sec. 112, Paragraph 6.

I claim:

1. An apparatus for plumbing and leveling a pole at an installation site comprising:
- multiple scissor jacks;
  - each scissor jack having a jack mount;
  - each jack mount has a scissor jack drop in plate and a scissor jack axle;
  - each scissor jack is fixedly connected to the respective scissor jack axle;
  - each scissor jack drop in plate is rotatably connected to the respective scissor jack axle;
- multiple pole brackets are equally arranged around the pole and connected with a strap;
  - each pole bracket having a first pole bracket side and a second pole bracket side;
  - each first pole bracket side has pole bracket arms to grasp a surface of the pole;
  - each second pole bracket side forms a receiving area to receive one of the scissor jack drop in plates;
  - each pole bracket having an opening for passing through the strap and securing around the pole;
- each scissor jack is adjustable with a turning screw;
  - a power drill or a hand crank to turn the turning screw and to adjust each scissor jack;
  - whereby after the pole is transported to the installation site and inserted into a hole, each scissor jack and the jack mount engage the receiving area of one of the second pole bracket sides;
  - whereby the power drill or the hand crank turns the turning screw to adjust respective scissor jack so that the pole and the apparatus are securely fixed in the hole of the installation site and so that the pole position can be adjusted to be plumb.

2. The apparatus of claim 1 wherein the receiving area of each pole bracket has a slot to receive a tab on one of the scissor jack drop in plates.

3. The apparatus of claim 1 wherein the power drill engages the turning screw of each scissor jack with a socket jack adapter; and the strap has a ratchet and a clip end.

4. The apparatus of claim 1 wherein the multiple pole brackets comprises three pole brackets and the multiple scissor lacks comprises three scissor jacks with jack mounts.

5. The apparatus of claim 1 wherein the first pole bracket side of each ole bracket has two pole bracket wedges or wings to help properly orient the pole.

6. The apparatus of claim 1 wherein each second pole bracket side has multiple wedges or wings to help orient the apparatus away from an inside surface of the hole.

7. The apparatus of claim 1 wherein each pole bracket has two openings for the strap.

8. An apparatus for plumbing and leveling a pole at an installation site comprising:
- at least three scissor jacks;
  - each scissor jack having a jack mount;
  - each jack mount has a scissor jack drop in plate and a scissor jack axle;
  - each scissor jack is fixedly connected to the respective scissor jack axle;
  - each scissor jack drop in plate is rotatably connected to the respective scissor jack axle;
- at least three pole brackets equally arranged around the pole and connected with a strap;
  - each pole bracket having a first pole bracket side and a second pole bracket side;
  - each first pole bracket side has two pole bracket arms to grasp a surface of the pole;
  - each second pole bracket side forms a receiving area to receive a side of one of the jack mounts;
  - each pole bracket having an opening for passing through the strap and securing around the pole;
- each scissor jack is adjustable with a turning screw;
  - a power drill to turn the turning screw and to adjust each scissor jack;
  - the power drill engages the turning screw with a socket jack adapter;
  - whereby after the pole is transported to the installation site and inserted into a hole, each scissor jack and each jack mount engage the receiving area of one of the second pole bracket sides;
  - whereby the power drill turns the turning screw to adjust the respective scissor jack so that the pole and the apparatus are securely fixed in the hole of the installation site and so that the pole position can be adjusted to be plumb.

9. The apparatus of claim 8 wherein the receiving area of each pole bracket has a slot to receive a tab on one of the scissor jack drop in plates.

10. The apparatus of claim 8 wherein a manual device or hand crank can turn the screw and adjust each scissor jack; and the strap has a ratchet and a clip end.

11. The apparatus of claim 8 wherein each scissor jack is fixedly connected to the respective scissor jack axle with nuts and bolts.

12. The apparatus of claim 8 wherein the first pole bracket side of each pole bracket has two pole bracket wedges or wings to help properly orient the pole.

13. The apparatus of claim 8 wherein each second pole bracket side has multiple wedges or wings to help orient the apparatus away from an inside surface of the hole.

14. The apparatus of claim 8 wherein each second pole bracket side has multiple wedges or wings to help orient the apparatus away from an inside surface of the hole; each multiple wedges or wings have tabs.

15. An apparatus for plumbing and leveling a pole in a hole at an installation site comprising:

at least three scissor jacks;

each scissor jack having a rotatable scissor jack drop in plate and a scissor jack axle;

each scissor jack is fixedly connected to the scissor jack axle;

at least three pole brackets equally arranged around the pole and connected with at least one strap;

each pole bracket having a first pole bracket side and a second pole bracket side;

each first pole bracket side has pole bracket arms to grasp a surface of the pole;

each second pole bracket side forms a receiving area to receive one of the scissor jack drop in plates;

each second pole bracket side has multiple wedges or wings to help orient the apparatus away from an inside surface of the hole;

each pole bracket having an opening for passing through the at least one strap and securing around the pole;

each scissor jack is adjustable with a turning screw;

a power drill to turn the turning screw and to adjust each scissor jack;

whereby after the pole is transported to the installation site and inserted into the hole, each scissor jack and each jack mount engage the receiving area of the second pole bracket side;

whereby the power drill turns the turning screw to adjust the scissor jack so that the pole and the apparatus are securely fixed in the hole of the installation site and so that the pole position can be adjusted to be plumb.

16. The apparatus of claim 15 wherein the receiving area of the pole bracket has a slot to engage one of the scissor jack drop in plates.

17. The apparatus of claim 15 wherein the first pole bracket side of each pole bracket has two pole bracket wedges or wings to help properly orient the pole.

18. The apparatus of claim 15 wherein the multiple wedges or wings have tabbed edges.

19. The apparatus of claim 15 wherein the power drill engages the turning screw of each scissor jack with a socket jack adapter.

20. The apparatus of claim 15 wherein a manual crank can turn the turning screw of each scissor jack to adjust the respective scissor jack.

* * * * *